US009354536B2

(12) United States Patent
Nakamura et al.

(10) Patent No.: US 9,354,536 B2
(45) Date of Patent: May 31, 2016

(54) TWO-COMPONENT DEVELOPING AGENT FOR DEVELOPING ELECTROSTATIC LATENT IMAGE AND METHOD FOR FORMING ELECTROPHOTOGRAPHIC IMAGE

(71) Applicant: Konica Minolta, Inc., Tokyo (JP)

(72) Inventors: Kosuke Nakamura, Hachioji (JP); Yoshiyasu Matsumoto, Fuchu (JP); Satoshi Uchino, Hino (JP); Hidehito Haruki, Hino (JP); Hiroyuki Kozuru, Otsuki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/288,488

(22) Filed: May 28, 2014

(65) Prior Publication Data

US 2014/0363762 A1 Dec. 11, 2014

(30) Foreign Application Priority Data

Jun. 7, 2013 (JP) ..... 2013-120318

(51) Int. Cl.

| | |
|---|---|
| ***G03G 9/113*** | (2006.01) |
| ***G03G 9/087*** | (2006.01) |
| ***G03G 9/097*** | (2006.01) |

(52) U.S. Cl.

CPC ..... *G03G 9/1139* (2013.01); *G03G 9/08771* (2013.01); *G03G 9/08791* (2013.01); *G03G 9/0975* (2013.01); *G03G 9/09775* (2013.01); *G03G 9/1133* (2013.01); *G03G 2215/0607* (2013.01)

(58) Field of Classification Search

CPC . G03G 9/1139; G03G 9/1133; G03G 9/1138; G03G 9/1131; G03G 9/08771; G03G 13/08; G03G 13/09; G03G 13/16

USPC ..... 430/111.35, 111.32, 111.33, 123.58

See application file for complete search history.

(56) References Cited

U.S. PATENT DOCUMENTS

| | | | | |
|---|---|---|---|---|
| 5,061,593 | A * | 10/1991 | Yoerger | G03G 9/1133 430/111.33 |
| 7,759,035 | B2 * | 7/2010 | Ninomiya | G03G 9/0812 430/108.1 |

FOREIGN PATENT DOCUMENTS

| | | | |
|---|---|---|---|
| JP | H07219280 | A | 8/1995 |
| JP | 3691085 | B2 | 6/2005 |
| JP | 2006-078982 | * | 3/2006 |

OTHER PUBLICATIONS

Japanese Patent Office machine-assisted English-language translation of JP 2006-078982 (pub. Mar. 2006).*

Grant, R. et al., ed., Grant & Hackh's Chemical Dictionary, fifth edition, McGraw-Hill Book Company, NY (1987), p. 435.*

* cited by examiner

*Primary Examiner* — Janis L Dote

(74) *Attorney, Agent, or Firm* — Lucas & Mercanti, LLP

(57) ABSTRACT

A two-component developing agent for developing an electrostatic latent image includes toner particles composed of toner base particles and an exterior additive attached on the toner base particles, and carrier particles composed of carrier core particles and a coating resin provided on the carrier core particles. The coating resin includes a sulfur atom and a resin obtained by polymerizing an isobutyl methacrylate monomer, and the toner base particles include a sulfur atom.

17 Claims, No Drawings

TWO-COMPONENT DEVELOPING AGENT FOR DEVELOPING ELECTROSTATIC LATENT IMAGE AND METHOD FOR FORMING ELECTROPHOTOGRAPHIC IMAGE

BACKGROUND OF THE INVENTION

1. Field of the Invention

The present invention relates to a two-component developing agent for developing an electrostatic latent image and a method for forming an electrophotographic image. More specifically, the present invention relates to a two-component developing agent that is used for developing an electrostatic image, causes no fogging and toner scattering and provides high-quality images even in hot and humid conditions, and a method for forming an electrophotographic image using the two-component developing agent.

2. Description of Related Art

In recent years, electrophotography has been used in a field of commercial printing and required to always be able to stably provide high-quality images. To meet such a requirement, it is need to use a two-component developing agent that has high durability and is difficult to be deteriorated due to changes in temperature and humidity and/or printing of a large number of sheets. Given this need, there are provided carrier particles composed of carrier core particles and a hydrophobic resin coat, e.g., a silicone resin coat, on the surface of the carrier core particles.

A silicone resin coat on the carrier core particles is hard and thus difficult to be worn. Therefore, when a "toner spent problem" (this means adhesion of fragments of toner particles, an exterior additive of toner particles and/or a component of the toner base particles to the surface of carrier particles) occurs on a silicone resin coat of carrier particles, the degree of the "toner spent problem" gradually increases, and chargeability of the carrier particles is deteriorated.

To avoid accumulation of a "toner spent problem", it is preferable to use a coating resin moderately easy to be worn so that the outer surface of the resin coat can be refreshed ("refresh" in this context means that the resin surface that is not deteriorated by the "toner spent problem" and fresh becomes exposed). Such a resin can be exemplified by a copolymer resin of an alicyclic methacrylate monomer and a linear methacrylate monomer described in Japanese Patent No. 3691085.

As a resin for avoiding the "toner spent problem" to the surface of carrier particles, Japanese Patent Application Laid-Open Publication No. Hei7-219280 describes a resin that has small adhesion force to toner particles and large water contact angle, and is obtained by polymerizing an isobutyl methacrylate monomer in a non-aquatic condition.

On the other hand, to obtain high-resolution and high-quality images, a chemical toner which is composed of small spherical particles and is produced by suspension polymerization or emulsion polymerization has recently been used. A chemical toner is produced in an aqueous medium and thus easy to absorb water. Hence, a chemical toner is characterized in that a change in the amount of charge of the toner based on changes in environmental temperature and humidity is larger than that of a toner produced by crushing, and thus a chemical toner has high environmental dependency. Because of the characteristics, even carrier particles coated with the resin produced by polymerizing an isobutyl methacrylate monomer are used, the amount of charge of a toner largely changes depending on changes in environmental temperature and humidity.

SUMMARY OF THE INVENTION

In light of the problems and circumstances described above, an object of the present invention, which has been conceived is to provide a two-component developing agent that has high durability and avoids fogging and toner scattering caused by a change in the amount of charge of toner particles based on changes in environmental temperature and humidity, especially by a decrease in the amount of charge of toner particles due to hot and humid conditions, and can provide high-quality images, and to provide a method for forming an electrophotographic image using the two-component developing agent for developing an electrostatic latent image.

According to a first aspect of the present invention, there is provided a two-component developing agent for developing an electrostatic latent image, including:

toner particles composed of toner base particles and an exterior additive attached on the toner base particles; and carrier particles composed of carrier core particles and a coating resin provided on the carrier core particles, wherein the coating resin includes a sulfur atom and a resin obtained by polymerizing an isobutyl methacrylate monomer, and the toner base particles include a sulfur atom.

According to a second aspect of the present invention, there is provided a method for forming an electrophotographic image, the method including:

a charge step;

an exposure step;

a development step; and a transfer step, wherein a two component developing agent used in the development step is the above-defined two component developing agent.

DESCRIPTION OF PREFERRED EMBODIMENTS

A two-component developing agent of the present invention for developing an electrostatic latent image (hereinafter also referred to simply as a "two-component developing agent") includes toner particles composed of toner base particles and an exterior additive attached on the toner base particles, and carrier particles composed of carrier core particles and a coating resin provided on the carrier core particles, wherein the coating resin includes a sulfur atom(s) and a resin obtained by polymerizing an isobutyl methacrylate monomer, and the toner base particles include a sulfur atom(s). The above features are common in embodiments of the present invention.

Preferably, the sulfur atom is included in the carrier coating resin as a member of a sulfa group or sulfonate group in the coating resin. This feature adequately enhances transfer of electrons and accelerates rise of the amount of charge.

Preferably, the sulfur atom is included in the toner base particles as a member of a sulfo group or a sulfonate group in the toner base particles. This feature adequately enhances transfer of electrons and accelerates rise of the amount of charge.

Preferably, the sulfur atom is included in the carrier coating resin as a member of a sulfo group or a sulfonate group present at an end of a molecular chain of the coating resin. This feature makes a larger number of the sulfur atoms be present on the outer surface of the resin because the end of the resin molecule tends to be oriented to the outer surface of the resin.

Preferably, the toner base particle is formed with a resin, and the sulfur atom is included in the toner base particles as a member of a sulfo group or a sulfonate group positioned at an end of a molecular chain of the resin forming the toner base particles. This feature makes a larger number of the sulfur atoms be positioned on the outer surface of the resin because the end of the resin molecule tends to be oriented to the outer surface of the resin.

Preferably, the isobutyl methacrylate monomer is included as a copolymer component in the coating resin in a content of 20% by mass or more. This feature increases hydrophobicity of the coating resin and reduces a change in the amount of charge based on environmental changes.

Preferably, a weight average molecular weight of the coating resin is 300,000 to 1,000,000. This feature makes the coating resin have a moderate strength so that the resin is moderately worn and the surface of the carrier particles can be refreshed.

Preferably, the resin obtained by polymerizing the isobutyl methacrylate monomer is obtained by suspension polymerization or emulsion polymerization. This feature orients the sulfur atoms which have high polarity to the outer surface of the particles.

Preferably, the sulfur atom included in the coating resin satisfies a ratio (S/C) of a content of the sulfur atom in the coating resin (S) to a content of a carbon atom in the coating resin (C) of from 0.002 to 0.01, which contents are obtained using an X-ray photoelectron spectrometer. This feature accelerates rise of the amount of charge of the toner particles as a result of given charge and electron transfer.

Preferably, the sulfur atom included in the toner base particles satisfies a ratio (S/C) of a content of the sulfur atom in the toner base particles (S) to a content of a carbon atom in the toner base particles (C) ranges from 0.001 to 0.006, which contents are obtained using an X-ray photoelectron spectrometer. This feature accelerates rise of the amount of charge of the toner particles as a result of given charge and electron transfer.

The two-component developing agent of the present invention can be suitably used in a method for forming an electrophotographic image, the method including at least a charge step, an exposure step, a development step and a transfer step.

The two-component developing agent of the present invention will now be described.

<<Two-Component Developing Agent>>

The two-component developing agent of the present invention includes toner particles composed of toner base particles and an exterior additive attached on the toner base particles, and carrier particles composed of carrier core particles and a coating resin provided on the carrier core particles. The coating resin includes a sulfur atom(s) and a resin obtained by polymerizing an isobutyl methacrylate monomer, and the toner base particles include a sulfur atom(s).

Constituents of the two-component developing agent of the present invention will now be described one by one.

<Carrier>

(Carrier Core Particle)

The carrier constitutes the two-component developing element of the present invention includes carrier particles composed of carrier core particles coated with a resin. Examples of the carrier core particles include metal powder such as iron powder, ferrite particles and particles in which metal powder and/or ferrite particles are dispersed. Among them, ferrite particles are preferable.

Preferable examples of the ferrite include heavy metal-containing ferrites that contain copper, zinc, nickel or manganese and light metal-containing ferrites that contain an alkali metal or alkali earth metal.

A ferrite used for carrier core particles is a compound represented by the formula $(MO)_x(Fe_2O_3)_y$, and preferably the molar ratio y of $Fe_2O_3$ constituting the ferrite ranges from 30 to 95 mol %. Ferrite particles having a molar ratio y in this range are easy to have desired magnetization. Such ferrite particles show advantages, e.g., providing a carrier that hardly causes carrier adhesion. In the formula, M represents a metal atom such as manganese (Mn), magnesium (Mg), strontium (Sr), calcium (Ca), titanium (Ti), copper (Cu), zinc (Zn), nickel (Ni), aluminum (Al), silicon (Si), zirconium (Zr), bismuth (Bi), cobalt (Co) and lithium (Li). Either of them can be used alone. Otherwise, two or more of them can be used in combination.

The carrier particles of the present invention preferably have a volume-based median diameter ($D_{50}$) within the range of 15 to 80 μm, and more preferably 20 to 70 μm. Carrier particles having such a volume-based median diameter stably form high-quality toner images. The volume-based median diameters of the carrier core particles and the carrier particles can be measured with a laser-diffraction grain-size distribution measuring device "HELOS and LODOS" (manufactured by Sympatec GmbH) equipped with a wet dispersion unit.

The carrier used in the present invention has an electrical resistivity of preferably from $10^7$ to $10^{12}$ Ω·cm, and more preferably from $10^8$ to $10^{11}$ Ω·cm. The carrier having an electrical resistivity in the above ranges is suitable for forming high-density toner images.

Preferably, the carrier used in the present invention has a saturated magnetization of from 30 to 80 $Am^2/kg$ and a remanent magnetization of 5.0 $Am^2/kg$ or less. A carrier having such magnetic properties is prevented from partial aggregation. Thus, the two-component developing agent including such a carrier can be homogeneously dispersed on a developing agent-conveying unit, and uniform and high-resolution toner images that show no inhomogeneous image density can be obtained.

The remanent magnetization of the carrier can be reduced by using a ferrite. A carrier having a small remanent magnetization has good fluidity, and the two-component developing agent including such a carrier can have homogeneous bulk density.

(Coating Resin)

The carrier particle used in the two-component developing agent of the present invention is composed of the above-described carrier particle coated with a coating resin obtained by polymerizing an isobutyl methacrylate monomer.

The resin obtained by polymerizing an isobutyl methacrylate monomer can be a resin obtained by polymerizing only an isobutyl methacrylate monomer or a copolymer resin obtained by an isobutyl methacrylate monomer and a different monomer(s). Preferably, the content of an isobutyl methacrylate monomer in the resin obtained by polymerizing the isobutyl methacrylate monomer is 20% by mass or more. The resin having this content of an isobutyl methacrylate monomer can provide advantages by virtue of its hydrophobicity, and can reduce a change in the amount of charge based on changes in environmental temperature and humidity.

Examples of monomers that can be used in combination with an isobutyl methacrylate monomer include linear methacrylate monomers and linear acrylate monomers such as a methyl methacrylate monomer, ethyl methacrylate monomer, propyl methacrylate monomer, n-butyl methacrylate monomer, hexyl methacrylate monomer, octyl methacrylate monomer, 2-ethylhexyl methacrylate monomer, methyl acrylate monomer, ethyl acrylate monomer, propyl acrylate monomer, n-butyl acrylate monomer, hexyl acrylate monomer, octyl acrylate monomer and 2-ethylhexyl acrylate monomer, and alicyclic methacrylate monomers containing a cycloalkyl ring of 3 to 7 carbons such as cyclopropyl methacrylate monomer, cyclobutyl methacrylate monomer, cyclopentyl methacrylate monomer, cyclohexyl methacrylate monomer and cycloheptyl methacrylate monomer.

The coating resin may be a copolymer of an isobutyl methacrylate monomer, the above-exemplified acrylic monomer and a styrene monomer such as styrene monomer, α-methyl styrene monomer and p-chlorostyrene monomer.

Among the above examples, to achieve both of wear resistance and electrical resistance of the coating resin, the coating resin is preferably a copolymer of an isobutyl methacrylate monomer and a methacrylate monomer. As to an acrylic monomer, a methyl methacrylate monomer is preferable, because methyl methacrylate has high wear resistance and thus a copolymer resin of an isobutyl methacrylate monomer and a methyl methacrylate monomer can be given adequate wear resistance.

The weight average molecular weight of the resin obtained by polymerizing an isobutyl methacrylate monomer ranges preferably from 300,000 to 1,000,000. The resin having the weight average molecular weight in this range has moderate strength and thus is moderately worn. Therefore, the surface of the carrier particles can be refreshed by moderate wearing of the coating resin.

(Method for Measuring Weight Average Molecular Weight)

The weight average molecular weight of the coating resin is measured using Gel Permeation Chromatography (GPC).

Specifically, a coating resin sample to be measured in dissolved in tetrahydrofuran to obtain a concentration of the sample of 1 mg/ml in the tetrahydrofuran. The dissolution of the sample takes 5 minutes using an ultrasonic dispersing device at room temperature. Then, the sample solution is filtrated using a membrane filter with a pore diameter of 2 μm. Thereafter, 10 μl of the sample solution is injected in a GPC device.

Conditions for GPC

Device: HLC-8220 (manufactured by TOSOH CORPORATION)

Column: TSK guard column and TSK gel Super HZM-M, triplet (manufactured by TOSOH CORPORATION)

Column temperature: 40° C.

Solvent: tetrahydrofuran

Flow rate: 0.2 ml/min

Detector: Refractive index detector (RI detector)

The weight average molecular weight is calculated by plotting a distribution of molecular weights of the sample on a standard curve drawn using mono-disperse polystyrene standard particles. To draw the standard curve, 10 points of the mono-disperse polystyrene particles are obtained.

(Sulfur Atom)

The coating resin used in the carrier particles of the present invention include sulfur atoms. The sulfur atom is included in the coating resin by using a monomer containing a sulfur atom(s) as a copolymer component or by adding a compound containing a sulfur atom(s) into the coating resin, for example.

It is most preferable that the sulfur atom is included in the coating resin as a member of a sulfo group or sulfonate group. In the present invention, it is preferable that the sulfur atom is introduced in the end(s) of the molecular chain of the coating resin by using a polymerization initiator containing a sulfur atom(s).

(Method for Introducing Sulfur Atom in Coating Resin)

A sulfur atom can be introduced in the coating resin by conducting the polymerization using a polymerization initiator containing a sulfur atom(s). In this case, a sulfur atom is introduced in the end(s) of the molecular chain of the coating resin.

A different method may be employable. For example, a sulfur atom can be introduced by making a surfactant remain in a resin obtained by polymerization by using a surfactant containing a sulfur atom(s) in its molecule in suspension polymerization or emulsion polymerization to form the coating resin.

(Polymerization Initiator Containing Sulfur Atom)

Examples of a polymerization initiator containing a sulfur atom(s) employable in the polymerization to form the coating resin used in the carrier particles of the present invention include persulfates such as ammonium persulfate, sodium persulfate and potassium persulfate. Among them, potassium persulfate is preferable.

In the present invention, it is preferable that a sulfur atom can be introduced in the end of the molecular chain of the coating resin as a member of a sulfo group or sulfonate group by using a polymerization initiator containing a sulfur atom(s), because this introduction enhances transfer of electrons and accelerates rise of the amount of charge.

(Surfactant Containing Sulfur Atom)

Preferably, the surfactant containing a sulfur atom(s) is an anionic surfactant. Examples of an anionic surfactant include surfactants containing a sulfo group(s) or sulfonate group(s) as a hydrophilic group, such as monoalkyl sulfonates ($ROSO_3^-M^+$), polyoxyethylene alkyl sulfonates ($RO(CH_2CH_2)_mSO_3^-M^+$) and alkylbenzene sulfonates ($RR'CH_2CHC_6H_4SO_3^-M^+$). Specific examples include sodium benzene sulfonate, ammonium dodecyl sulfonate, sodium dodecyl sulfonate, sodium dodecyl polyoxyethylene ether sulfonate, triethanolamine polyoxyethylene dodecyl ether sulfonate, fatty alcohol sodium sulfonates and triethanolamine dodecyl sulfonate. Among them, sodium benzene sulfonate is preferable.

By using the above method, a sulfur atom(s) can be introduced in the coating resin as a member of a sulfo group or sulfonate group. The content of the sulfur atom in the coating resin satisfies the ratio (S/C) of the content of the sulfur atom (S) in the coating resin to the content of the carbon atom (C) in the coating resin of from 0.002 to 0.01, which contents are obtained using an X-ray photoelectron spectrometer.

(Method for Measuring Content of Sulfur Atom)

The content of the sulfur atom in the coating resin can be measured using an X-ray photoelectron spectrometer.

Specifically, an X-ray photoelectron spectrometer "K-Alpha" (manufactured by Thermo Fisher Scientific K.K.) is used under the following conditions to conduct a quantitative analysis of the sulfur atom and the carbon atom. Then, the surface concentrations of these elements are each calculated from the peak areas of these elements using a relative sensitivity factor, and the ratio (S/C) of the content of the sulfur atom in the coating resin (S) to the content of the carbon atom in the coating resin (C) is calculated to obtain the content ratio of the sulfur atom.

(Advance Preparation)

The developing agent, a slight amount of a neutral detergent and pure water are poured into a beaker and are mixed well with each other. Then, the supernatant is discharged from the beaker while a magnet is put on the outer surface of the bottom of the beaker. Subsequently, pure water is added again in the beaker and then the supernatant is discharged from the beaker to remove the toner and the neutral detergent and separate only the carrier, followed by heating at 40° C. The carrier is thus obtained.

(Preparation of Sample to be Measured)

The obtained carrier is put in wells (3 mm wide and 1 mm depth) of a plate used for powder measurement. The sample in the wells is then leveled at the surface of the plate and subjected to the measurement.

(Conditions for Measurement)

X ray: Al monochromatic ray source

Acceleration condition: 12 kV, 6 mA

Spot size: 400 μm

Pass energy: 50 eV

Step size: 0.1 eV (Method for Producing Carrier Particles)

The carrier particles of the present invention is composed of carrier core particles and a resin coating the carrier core particles. A method for coating carrier core particles with a resin is preferably a dry coating. In dry coating, HYBRIDIZER including a rotor and a liner (manufactured by NARA MACHINERY CO., LTD.) may be used, but preferably a high-speed agitator with horizontal agitation blades is used.

(Average Thickness of Coating Resin Layer)

The average thickness of the coating resin layer on the carrier particles ranges preferably from 0.05 to 4.0 μm, and more preferably 0.2 to 3.0 μm to provide the carrier particles with durability and low electrical resistance. When the average thickness is within this range, the chargeability and the durability of the carrier particles can be adjusted to desired levels. The average thickness of the coating resin layer can be calculated by the following method.

Thin slices of the carrier particles are prepared with a focused ion beam sample preparation device ("SMI2050", manufactured by SII NanoTechnology Inc.), and then the thin slices are observed with a transmission electron microscope ("JEM-2010F", manufactured by JEOL Ltd.) with 5,000-fold magnification. Thereafter, thicknesses of the thickest and the thinnest parts of the resin coating layers observed with this magnification are averaged to obtain the average thickness of the resin coating layer.

<Toner>

The toner in the two-component developing agent of the present invention includes toner particles composed of toner base particles that contains sulfur atoms and an exterior additive(s) attached on the toner base particles.

(Toner Base Particle)

The toner base particle of the present invention includes at least a binder resin (hereinafter also referred to as a toner resin) and sulfur atoms, and as needed, further includes a colorant. Additionally, the toner base particle may further include other agents such as a releasing agent and a charge-controlling agent.

The sulfur atom may be included in the toner base particle as a component element of the binder resin, or included in the toner base particle by adding a compound that contains a sulfur atom(s).

(Sulfur Atom)

The toner base particle of the present invention includes sulfur atoms. The sulfur atom may be included in the toner base particle as a component element of the binder resin, or included in the toner base particle by adding a compound that contains a sulfur atom(s).

(Method for Introducing Sulfur Atom in Toner Base Particle)

A sulfur atom can be introduced in the toner base particle by emulsion polymerization of the binder resin forming the toner base particle using the above-described polymerization initiator. By this way, a sulfur atom(s) can be introduced in the end of the molecular chain of the toner resin.

In the present invention, it is preferable that a polymerization initiator containing a sulfur atom(s) is used to introduce a sulfur atom(s) in the end(s) of the molecular chain of the binder resin forming the toner base particle as a member of a sulfo group or sulfonate group, because this method can position a larger number of the sulfur atoms on the surface of the toner base particles.

Otherwise, a sulfur atom can be introduced in the toner base particle by using a surfactant containing a sulfur atom(s) in suspension polymerization or emulsion polymerization to form the binder resin in order that a surfactant remains in the binder resin.

A sulfur atom can be introduced in the toner base particle also by producing the toner base particle by emulsion aggregation. Specifically, the toner resin is produced by emulsion polymerization using a surfactant containing a sulfur atom(s), and then an aqueous dispersion liquid of the resin and an aqueous dispersion liquid of a colorant are mixed with each other to cause aggregation and fusion and form the toner base particle. By this method, a sulfur atom(s) can be included in the toner base particle as a member of the surfactant.

(Polymerization Initiator)

The polymerization initiator that contains a sulfur atom(s) and is used in suspension polymerization or emulsion polymerization to produce the binder resin forming the toner base particle may be selected from the examples of the above polymerization initiator used in producing the coating resin. Among the above examples, potassium persulfate is preferable.

(Surfactant)

The surfactant that contains a sulfur atom(s) and is used in suspension polymerization to form the toner base particle may be selected from the above examples of the surfactant used in producing the coating resin. Among these examples, sodium dodecyl sulfate is preferable.

By using the above method, a sulfur atom(s) can be introduced in the toner base particle as a member of a sulfo group or sulfonate group. The content of the sulfur atom in the toner base particle satisfies the ratio (S/C) of the content of the sulfur atom (S) in the toner base particle to the content of the carbon atom (C) in the toner base particle of from 0.001 to 0.006, which contents are obtained using an X-ray photoelectron spectrometer.

(Method for Measuring Content of Sulfur Atom)

The content of the sulfur atom in the toner base particle can be measured using an X-ray photoelectron spectrometer by the same way as the content of the sulfur atom in the coating resin is measured.

Specifically, an X-ray photoelectron spectrometer "K-Alpha" (manufactured by Thermo Fisher Scientific K.K.) is used under the following conditions to conduct a quantitative analysis of the sulfur atom and the carbon atom. Then, the surface concentrations of these elements are each calculated from the Peak areas of these elements using a relative sensitivity factor, and the ratio (S/C) of the content of the sulfur atom in the toner base particle (S) to the content of the carbon atom in the toner base particle (C) is calculated to obtain the content ratio of the sulfur atom.

(Preparation of Sample to be Measured)

The toner is put in wells (3 mm wide and 1 mm depth) of a plate used for powder measurement. The sample in the wells is then leveled at the surface of the plate and subjected to the measurement.

(Conditions for Measurement)
X ray: Al monochromatic ray source
Acceleration condition: 12 kV, 6 mA
Spot size: 400 μm
Pass energy: 50 eV
Step size: 0.1 eV (Binder Resin)

The binder resin constituting the toner base particle is preferably a thermoplastic resin.

A conventional resin for forming a toner particle may be used without particular limitation. Specific examples include styrene resins, acrylic resins such as alkyl acrylate resin and alkyl methacrylate resin, acrylic styrene copolymer resins, polyester resins, silicone resins, olefin resins, amide resins and epoxy resins.

Among them, styrene resins, acrylic resins, acrylic styrene copolymer resins and polyester resins are preferable because they have low viscosity and sharp-melting properties. It is preferable that an acrylic styrene copolymer resin is a main component of the toner base particle and the content of this resin in the toner base particle is 50% or more. One of the above-listed examples of the binder resin may be used alone, or two or more thereof may be used in combination.

Examples of a polymerizable monomer for forming the binder resin include styrene monomers such as styrene, methyl styrene, methoxy styrene, butyl styrene, phenyl styrene and chloro styrene; methacrylate monomers such as methyl methacrylate, ethyl methacrylate, butyl methacrylate and ethylhexyl methacrylate; acrylate monomers such as methyl acrylate, ethyl acrylate, butyl acrylate and ethylhexyl acrylate; and carboxylic acid monomers such as acrylic acid, methacrylic acid and fumaric acid.

One of these examples may be used alone, or two or more of these examples may be used in combination.

Preferably, the binder resin constituting the toner base particle has a glass transition temperature (Tg) of 30 to 50° C. The glass transition temperature in this range provides good fixity in low temperatures and storability in hot conditions of the toner.

(Method for Measuring Glass Transition Temperature)

The glass transition temperature (Tg) of the binder resin can be measured using "Diamond Differential scanning calorimetry (Diamond DSC)" (manufactured by PerkinElmer Inc.).

The glass transition temperature can be measured as follows: First, 3.0 mg of the toner is put in an aluminum pan, and then the sample-containing aluminum pan is set on a holder of "Diamond DSC". A vacant aluminum pan is used as a reference. Measurement is performed at a measuring temperature ranging from 0 to 200° C., at 10° C. of a temperature increase rate per minute, at 10° C. of a decrease rate per minute, under a temperature control of Heat-Cool-Heat. Data obtained in the second Heat is used for analysis.

The glass transition temperature corresponds to an intersection point of an extended line from a point of a base line just before a rising phase of a first heat sink peak and a tangential line having a maximum gradient between the rising phase of the first heat sink peak and the top of the peak.

Preferably, the softening temperature of the binder resin ranges is within the range of 80 to 130° C., and more preferably within the range of 90 to 120° C. The softening temperature can be measured by, for example, using a flow tester "CFT-500D" (manufactured by Shimadzu Corporation).

(Colorant)

The colorant constituting the toner base particle may be any colorant such as carbon black, magnetic bodies or organic colorants.

Examples of the organic colorant include C.I. Pigment Red 2, 3, 5, 7, 15, 16, 48:1, 48:3, 53:1, 57:1, 81:4, 122, 123, 139, 144, 149, 166, 177, 178, 208, 209 and 222; C.I. Pigment Orange 31 and 43; C.I. Pigment Yellow 3, 9, 14, 17, 35, 36, 65, 74, 83, 93, 94, 98, 110, 111, 138, 139, 153, 155, 180, 181 and 185; C.I. Pigment Green 7; C.I. Pigment Blue 15:3, 15:4 and 60; and phthalocyanine pigment containing zinc, titanium, magnesium or the like as the central metal. A mixture of the above examples may also be used. Examples of dyes include C.I. Solvent Red 1, 3, 14, 17, 18, 22, 23, 49, 51, 52, 58, 63, 87, 111, 122, 127, 128, 131, 145, 146, 149, 150, 151, 152, 153, 154, 155, 156, 157, 158, 176 and 179; pyrazolo-triazole azo dye; pyrazolo-triazole azomethine dye; pyrazolone azo dye; pyrazolone azomethine dye; C.I. Solvent Yellow 19, 44, 79, 81, 82, 93, 98, 103, 104, 112 and 162; C.I. Solvent Blue 25, 36, 60, 70, 93 and 95. A mixture of the above examples may also be used.

The content of the colorant is preferably 1 to 30% by mass, and more preferably 2 to 20% by mass in the toner.

(Releasing Agent)

A releasing agent may be included in the toner base particle. Any releasing agent may be used without particular limitation. Examples include hydrocarbon waxes such as polyethylene wax, oxidized polyethylene wax, polypropylene wax and oxidized polypropylene wax, carnauba wax, fatty acid ester wax, Sasolwax, rice bran wax, candelilla wax, jojoba wax and beeswax.

The content of the releasing agent in the toner base particle is normally 1 to 30 parts by mass, and preferably 5 to 20 parts by mass per 100 parts by mass of the binder resin for forming the toner base particle.

(Charge-Controlling Agent)

A charge-controlling agent may be included in the toner base particle. Examples include metal complexes of a salicylic acid derivative and zinc, aluminum or the like (salicylic acid metal complexes), calixarene compounds, organic boron compounds and fluorine-containing quaternary ammonium salts.

The content of the charge-controlling agent in the toner base particle is normally 0.1 to 5.0 parts by mass per 100 parts by mass of the binder resin.

(Method for Producing Toner Base Particle)

The toner of the present invention is composed of the toner particles, and the toner particles are composed of the toner base particles and an exterior additive(s) attached on the toner base particles. Examples of a method for producing the toner base particles include kneading crushing, suspension polymerization, emulsion aggregation, dissolution suspension, polyester elongation and dispersion polymerization.

Among these methods, emulsion aggregation is preferable for obtaining similar particle diameters, controllability of particle shape and easiness of forming a core-shell structure which enhance achievement of high-quality images and high stability.

In emulsion aggregation, a dispersion liquid in which toner resin fine particles are dispersed in the presence of a surfactant or dispersion-stabilizing agent is mixed with a dispersion liquid of fine particles of a component of the toner base particle such as a colorant if needed, and an aggregating agent is added to the dispersion liquid of the resin fine particles or the mixture of the dispersion liquids to cause aggregation until the diameters of the toner base particles increase to a desired level. Then, after or at the same time of the aggregation, the aggregated resin fine particles are fused together and the shapes of the particles are controlled. The toner base particles are thus produced.

The toner resin fine particle may contain an interior additive(s) such as a releasing agent and a charge-controlling agent. The toner resin particle may be composed of two or more layers each formed of a resin having a composition different from each other.

It is preferable that, at the aggregation, fine particles of another resin different from the toner resin is further added to the dispersion of the toner resin to form toner base particles with a core-shell structure, in terms of construction of the toner base particles.

The toner base particles can be produced by emulsion, mini-emulsion polymerization or phase-transfer emulsification, or a combination of two or more of them. When an interior additive(s) are contained to the toner resin fine particles, mini-emulsion polymerization is preferable.

(Method for Adding Exterior Additive)

An exterior additive may be added to the toner base particles as needed. Specifically, an exterior additive is added to the toner base particles which have been dried and is agitated with the toner base particles to form toner particles.

The toner base particles which have been dried and prepared may be used as toner particles. However, in terms of improvements in chargeability, fluidity and cleaning properties of the toner, known particles such as inorganic fine particles and organic fine particles and/or an unguent are added on the surface of the dried toner base particles.

A method for adding an exterior additive to the toner base particles may be exemplified by a dry method for adding powder of an exterior additive to the dried toner base particles. Examples of a mixer used in a dry method include mechanical mixing devices such as HENSCHEL mixers and coffee mills.

(Size of Toner Particle)

Preferably, the toner particle of the present invention has a volume-based median diameter ($D_{50}$) of 3 to 8 μm.

The volume-based median diameter ($D_{50}$) of the toner particle can be measured using a device composed of "COULTER MULTISIZER 3" (manufactured by Beckman Coulter, Inc.) and a computer system including data processing software "SOFTWARE V 3.51" connected thereto.

Specifically, 0.02 g of the toner particle is added to 20 ml of a surfactant solution (e.g., 10-fold diluted solution of a neutral detergent containing a surfactant component with pure water) and mixed. Thereafter, ultrasonic dispersion is conducted for 1 minute, and a toner dispersion liquid is obtained. Then, the obtained toner dispersion liquid is injected into a beaker that contains "ISOTON II" (manufactured by Beckman Coulter, Inc.) and put in a sample stand using a pipette. The injection is continued until the concentration displayed on the measuring device reaches 8%. By adjusting the concentration to this value, reproducible measured values can be ensured. In the measuring device, the number of counts is determined to 25,000 and an aperture diameter is determined to 50 μm. A range to be measured is determined to range from 1 to 30 μm and divided into 256 parts, and then the frequencies of particle diameters are calculated. The volume-based median diameter ($D_{50}$) is a particle diameter at 50% value of volume-based integration.

(Average Degree of Circularity)

The toner particles of the present invention have an average degree of circularity ranging preferably from 0.900 to 0.970, and more preferably from 0.930 to 0.965, in view of improvement of transfer efficiency. The average degree of circularity can be measured using a flow-type particle image analyzer "FPIA-2100" (manufactured by SYSMEX CORPORATION). Specifically, the toner particles are added to an aqueous solution of a surfactant and mixed with each other, followed by ultrasonic dispersion for 1 minute using an ultrasonic dispersing device. Then, pictures are taken in HPF (high magnification imaging) mode at a concentration that is suitable for a detecting count in HPF of from 3,000 to 10,000, and the degree of circularity of each toner particle is calculated according to the following equation (1). All of the obtained degrees of circularity of the toner particles are totalized, and the total is divided by the total number of the toner particles. In the equation (1), "equivalent circle diameter" means the diameter of a circle having the same area as the particle image.

Degree of circularity=boundary length obtained from equivalent circle diameter/boundary length of particle projection image Equation (1):

<Method for Producing Developing Agent>

The two-component developing agent of the present invention can be produced by mixing the carrier and the toner using a mixing device.

Examples of the mixing device include HENSCHEL mixers (manufactured by NIPPON COKE & ENGINEERING. CO., LTD.), NAUTA mixers (manufactured by Hosokawa Micron) and V-type mixers.

The content of the toner in the two-component developing agent is preferably 3 to 15 parts by mass, and more preferably 4 to 10 parts by mass per 100 parts by mass of the carrier.

<<Method for Forming Electrophotographic Image>>

The two-component developing agent of the present invention can be used in various known methods for forming images using electrophotography, e.g., a method for forming monochrome images and a method for forming full-color images. As to a method for forming full-color images, the two-component developing agent of the present invention can be used in a four-cycle electrophotographic image-forming method using four color developing units each corresponding to yellow, magenta, cyan or black and an electrostatic latent image carrier (also simply referred to as a electrophotographic photoreceptor or just a photoreceptor) and a tandem-type image-forming method using four image-forming units each of which includes a color developing unit and an electrostatic latent image carrier and corresponds to one color.

Specifically, by a method for forming electrophotographic images, a visible image can be obtained by the following steps: charge of the two-component developing agent of the present invention on an electrostatic latent image carrier using a charging device (charge step); formation of an electrostatic latent image by image exposure (exposure step); obtainment of a toner image by developing the electrostatic latent image with the toner particles charged using the carrier particles in the two-component developing agent (development step); transfer of the toner image on a sheet (transfer step); and fixing of the toner image on the sheet through fixing treatment such as contact heating (fixing step).

EXAMPLES

The present invention will be specifically described with reference to Examples, but the present invention is not limited thereto. In the description of EXAMPLES, "part (s)" and "%" mean "part(s) by mass" and "% by mass (mass %)", respectively, unless described otherwise.

<<Production of Coating Resin Used for Coating Carrier Particle>>

<Production of Coating Resin 1>

To 300 parts by mass of 0.3 mass % sodium benzene sulfonate aqueous solution, 100 parts by mass of an isobutyl methacrylate monomer and a methyl methacrylate monomer in total was added in a mass ratio (copolymerizing ratio) of the isobutyl methacrylate monomer to the methyl methacrylate monomer of 50:50, and then potassium persulfate was added to the solution to cause emulsion polymerization. The amount of the added potassium persulfate was 0.5 mass % of the total amount of the monomers. Thereafter, spray drying was performed. A coating resin 1 was thus produced. The weight average molecular weight of the obtained coating resin 1 was 500,000. This weight average molecular weight was obtained by using the above-described device.

<Production of Coating Resin 2>

A coating resin 2 was produced by the same way as the coating resin 1 was produced except that the amount of the added potassium persulfate was 0.2 mass % of the total amount of the monomers.

<Production of Coating Resin 3>

A coating resin 3 was produced by the same way as the coating resin 1 was produced except that the amount of the added potassium persulfate was 0.7 mass % of the total amount of the monomers.

<Production of Coating Resin 4>

A coating resin 4 was produced by the same way as the coating resin 1 was produced except that the amount of the added potassium persulfate was 1.5 mass % of the total amount of the monomers.

<Production of Coating Resins 5 to 8, 11 to 14 and 16 to 18>

Coating resins 5 to 8, 11 to 14 and 16 to 18 were produced by the same way as the coating resin 1 was produced except that materials shown in Table 1 were used.

<Production of Coating Resin 9>

A coating resin 9 was produced by the same way as the coating resin 1 was produced except that sodium benzene sulfonate was further added after the emulsion polymerization in an amount of 0.5 mass % of the total amount of the monomers, and then the spray drying was performed.

<Production of Coating Resin 10>

A coating resin 10 was produced by the same way as the coating resin 1 was produced except that sodium benzene sulfonate was further added after the emulsion polymerization in an amount of 0.8 mass % of the total amount of the monomers, and then the spray drying was performed.

<Production of Coating Resin 15>

A coating resin 15 was produced by the same way as the coating resin 14 was produced except that, after the emulsion polymerization, the solution was filtrated, 1000 parts by mass of ion-change water was then added to perform reslurry, the reslurry was performed three times and the spray drying was performed.

<Production of Coating Resin 19>

A coating resin 19 was produced by the same way as the coating resin 1 was produced except that 100 parts by mass of an isobutyl methacrylate monomer and a methyl methacrylate monomer in total was added in a mass ratio (copolymerizing ratio) of the isobutyl methacrylate monomer to the methyl methacrylate monomer of 50:50, and benzoyl peroxide was added in an amount of 0.3 mass % of the total amount of the monomers to cause bulk polymerization of the monomers.

TABLE 1

| | Monomer 1 | Monomer 2 | Copolymerizing ratio (by mass) | Surfactant | Polymerization initiator | Weight average MW | S/C |
|---|---|---|---|---|---|---|---|
| Coating resin 1 | Isobutyl methacrylate | Methyl methacrylate | 50/50 | Sodium benzene sulfonate | Potassium persulfate | 500,000 | 0.0075 |
| Coating resin 2 | Isobutyl methacrylate | Methyl methacrylate | 50/50 | Sodium benzene sulfonate | Potassium persulfate | 1,000,000 | 0.0072 |
| Coating resin 3 | Isobutyl methacrylate | Methyl methacrylate | 50/50 | Sodium benzene sulfonate | Potassium persulfate | 300,000 | 0.0076 |
| Coating resin 4 | Isobutyl methacrylate | Methyl methacrylate | 50/50 | Sodium benzene sulfonate | Potassium persulfate | 100,000 | 0.0078 |
| Coating resin 5 | Isobutyl methacrylate | — | 100/0 | Sodium benzene sulfonate | Potassium peroxymonosulfate | 500,000 | 0.0069 |
| Coating resin 6 | Isobutyl methacrylate | Methyl methacrylate | 80/20 | Sodium benzene sulfonate | Potassium peroxymonosulfate | 500,000 | 0.0073 |
| Coating resin 7 | Isobutyl methacrylate | Methyl methacrylate | 20/80 | Sodium benzene sulfonate | Potassium peroxymonosulfate | 500,000 | 0.0074 |
| Coating resin 8 | Isobutyl methacrylate | Methyl methacrylate | 5/95 | Sodium benzene sulfonate | Potassium peroxymonosulfate | 500,000 | 0.0072 |
| Coating resin 9 | Isobutyl methacrylate | Methyl methacrylate | 50/50 | Sodium benzene sulfonate | Potassium persulfate | 500,000 | 0.0100 |
| Coating resin 10 | Isobutyl methacrylate | Methyl methacrylate | 50/50 | Sodium benzene sulfonate | Potassium persulfate | 500,000 | 0.0120 |
| Coating resin 11 | Isobutyl methacrylate | Methyl methacrylate | 50/50 | Sodium benzene sulfonate | Sodium persulfate | 500,000 | 0.0070 |
| Coating resin 12 | Isobutyl methacrylate | Methyl methacrylate | 50/50 | Sodium benzene sulfonate | Potassium peroxymonosulfate | 500,000 | 0.0068 |
| Coating resin 13 | Isobutyl methacrylate | Methyl methacrylate | 50/50 | Alkylaryl polyethylene glycol ether | Potassium peroxymonosulfate | 500,000 | 0.0055 |
| Coating resin 14 | Isobutyl methacrylate | Methyl methacrylate | 50/50 | Sodium benzene sulfonate | t-butyl hydroperoxide | 500,000 | 0.0043 |
| Coating resin 15 | Isobutyl methacrylate | Methyl methacrylate | 50/50 | Sodium benzene sulfonate | t-butyl hydroperoxide | 500,000 | 0.0020 |
| Coating resin 16 | Styrene | Methyl methacrylate | 50/50 | Sodium benzene sulfonate | Potassium peroxymonosulfate | 500,000 | 0.0073 |
| Coating resin 17 | Cyclohexyl acrylate | Methyl methacrylate | 50/50 | Sodium benzene sulfonate | Potassium peroxymonosulfate | 500,000 | 0.0072 |
| Coating resin 18 | Isobutyl methacrylate | Methyl methacrylate | 50/50 | Alkylaryl polyethylene glycol ether | t-butyl hydroperoxide | 500,000 | 0 |
| Coating resin 19 | Isobutyl methacrylate | Methyl methacrylate | 50/50 | - (Bulk polymerization) | Benzoyl peroxide | 500,000 | 0 |

<Production of Care Particle>

(Provision of Carrier Core Particle)

Mn—Mg-based ferrite particles having a volume average diameter (volume-basis median diameter) of 60 μm and a saturation magnetization of 63 $A \cdot m^2/kg$ were prepared.

<Production of Carrier Particle 1>

In a high-speed agitator with horizontal agitation blades, 100 parts by mass of the above ferrite particles were added as the carrier core particles, and 3.5 parts by mass of the coating resin 1 was added. Then, they are mixed in the agitator at a peripheral speed of the horizontal rotation blades of 8 m/sec and 22° C. for 15 minutes. Subsequently, mixing was further performed at 120 C for 15 minutes to coat the core particles with the coating resin 1 utilizing mechanical impact (i.e., a mechanochemical method). Carrier particles 1 were thus produced.

<Production of Carrier Particles 2 to 19>

Carrier particles 2 to 19 were produced by the same way as the carrier particles 1 were prepared except that the coating resin 2 to 19 were used, respectively.

<Production of Toner Particle>

Toner particles were produced as described below.

<Production of Toner Particle 1>

(Production of Core-Use Resin Fine Particle)

(Preparation of Resin Fine Particle [1H] Dispersion Liquid)

In a reaction container equipped with a stirring unit, a temperature sensor, a cooling tube and a nitrogen gas-injecting unit, a surfactant solution was prepared by dissolving 7.08 parts by mass of sodium dodecyl sulfate in 3010 parts by mass of ion-exchange water. Then, the prepared surfactant solution was stirred at 230 rpm in a nitrogen gas flow, and the temperature in the reaction container was increased to 80° C.

Thereafter, to the resulting surfactant solution, a polymerization initiator solution in which 9.2 parts by mass of potassium persulfate (KPS) was dissolved in 200 parts by mass of ion-exchange water was added, and then the temperature in the reaction container was decreased to 75° C.

Subsequently, an hour was spent to drop a mixture liquid [a1] composed of the compounds below into the reacted solution, and then the solution was stirred at 75° C. for 2 hours to cause polymerization. A resin fine particle [1H] dispersion liquid in which resin fine particles [1H] were dispersed was thus prepared.

| Composition of Mixture Liquid [a1] | |
|---|---|
| Styrene | 69.4 parts by mass |
| n-butyl acrylate | 28.3 parts by mass |
| Methacrylic acid | 2.3 parts by mass |

(Preparation of Resin Fine Particle [1HM] Dispersion Liquid)

To a flask equipped with a stirring unit, the following compounds were added.

| | |
|---|---|
| Styrene | 97.1 parts by mass |
| n-butyl acrylate | 39.7 parts by mass |
| Methacrylic acid | 3.2 parts by mass |
| n-octyl-3-mercaptopropionate | 5.6 parts by mass |

Then, 98.0 parts by mass of pentaerythritol tetrabehenate was further added to the flask, and the temperature in the flask was increased to 90° C. to prepare a mixture liquid [a2] composed of the above compounds.

On the other hand, in a reaction container equipped with a stirring unit, a temperature sensor, a cooling tube and a nitrogen gas-injecting unit, a surfactant solution was prepared by dissolving 1.6 parts by mass of sodium dodecyl sulfate in 2700 parts by mass of ion-exchange water, and heated to 98° C. To the resulting surfactant solution, 28 parts by mass (on a solid content basis) of the resin fine particle [1H] dispersion liquid was added, and thereafter the mixture liquid [a2] was also added thereto. Then, a mechanical dispersing device including a cyclic path, "CLEARMIX" (manufactured by M Technique Co., Ltd.), was used to perform mixing and dispersing for 2 hours to obtain a dispersion liquid (i.e., emulsion).

Subsequently, a polymerization initiator solution in which 5.1 parts by mass of potassium persulfate (KPS) was dissolved in 750 parts by mass of ion-exchange water was added to the emulsion. Then, the obtained reaction liquid was stirred at 98° C. for 2 hours to cause polymerization to obtain a resin fine particle [1HM] dispersion liquid in which resin fine particles [1HM] with a composite structure where the resin fine particles [1H] were coated with the resin were dispersed.

(Preparation of Resin Fine Particle [1HML] Dispersion Liquid)

To the resin fine particle [1HM] dispersion liquid, a polymerization initiator solution prepared by dissolving 7.4 parts by mass of potassium persulfate (KPS) in 200 parts by mass of ion-exchange water, and the temperature of the resulting liquid was increased to 80° C. Then, an hour was taken to drop a mixture liquid [a3] composed of the following compounds into the resulting liquid. After the dropping, the temperature was maintained at 80° C. and the resulting liquid was stirred with heat for 2 hours to cause polymerization. Thereafter, the resulting reaction liquid was cooled to 28° C. to obtain a resin fine particle [1HML] dispersion liquid in which resin fine particles [1HML] with a composite structure where the resin fine particles [1HM] were coated with the resin were dispersed. The obtained resin fine particle [1HML] dispersion liquid was defined as a core-use resin fine particle dispersion liquid.

| | |
|---|---|
| Styrene | 277 parts by mass |
| n-butyl acrylate | 113 parts by mass |
| Methacrylic acid | 9.2 parts by mass |
| n-octyl-3-mercaptopropionate | 10.4 parts by mass |

(Preparation of Shell-Use Resin Fine Particle [1] Dispersion Liquid)

In a reaction container equipped with a stirring unit, a temperature sensor, a cooling tube and a nitrogen gas-injecting unit, a surfactant solution was prepared by dissolving 2.0 parts by mass of sodium dodecyl sulfate which is an anionic surfactant in 3000 parts by mass of ion-exchange water. Then, the prepared surfactant solution was stirred at 230 rpm in a nitrogen gas flow, and the temperature in the reaction container was increased to 80° C.

On the other hand, the following compounds were mixed with each other to prepare a mixture liquid [a4].

| | |
|---|---|
| Styrene | 544 parts by mass |
| n-butyl acrylate | 160 parts by mass |
| Methacrylic acid | 96 parts by mass |
| n-octyl mercaptan | 20 parts by mass |

To the surfactant solution, a polymerization initiator solution prepared by dissolving 10 parts by mass of potassium persulfate (KPS) in 200 parts by mass of ion-exchange water was added, and then three hours were taken to drop the mixture liquid [a4] into the resulting solution. This obtained reaction liquid was heated to 80° C. and stirred with heat for an hour to cause polymerization. A shell-use resin fine particle [1] dispersion liquid was thus prepared.

(Preparation of Carbon Black Dispersion Liquid [1])

A solution prepared by mixing and dissolving 90 parts by mass of sodium dodecyl sulfate in 1600 parts by mass of ion-exchange water was continuously stirred, and to this solution under stirring, 420 parts by mass of carbon black "MOGUL L" (manufactured by Cabot Corporation) was gradually added. Subsequently, an agitator "CLEARMIX" (manufactured by M Technique Co., Ltd.) was used to perform dispersion treatment to prepare a carbon black dispersion liquid [1]. A mass-average particle diameter of the carbon black particles in the dispersion liquid was 110 nm, which mass-average particle diameter was obtained using an electrophoretic light-scattering photometer "ELS-800" (manufactured by OTSUKA ELECTRONICS CO., LTD.).

(Formation of Core Particle)

In a reaction container equipped with a stirring unit, a temperature sensor, a cooling tube and a nitrogen gas-injecting unit, the following compounds were put.

| | |
|---|---|
| Core-use resin fine particle dispersion liquid (on a solid content basis) | 450 parts by mass |
| Ion-exchange water | 1100 parts by mass |
| Carbon black dispersion liquid [1] (on a solid content basis) | 100 parts by mass |

Then, the temperature of the liquid was controlled to 30° C. Thereafter, a 5 M aqueous solution of sodium hydroxide was added to the liquid, and its pH was adjusted to 10.0.

The obtained reaction liquid was continuously stirred, and then 10 minutes were taken to add an aqueous solution prepared by dissolving 60 parts by mass of magnesium chloride hexahyarate in 60 parts by mass of ion-exchange water to the reaction liquid under stirring. After the addition, the reaction liquid was left stand for three minutes. Then, increasing of the temperature of the reaction liquid was started, and 60 minutes were taken to increase the temperature of the reaction liquid to 90° C. The particles were associated with each other to increase the particle size, while the temperature was maintained at 90° C. The increase of the particle size was confirmed by measuring the diameters of the associated particles using "MULTISIZER 3" (manufactured by Beckman Coulter, Inc.). When a volume-based median diameter ($D_{50}$) reached 5.5 μm, an aqueous solution in which 40.2 parts by mass of sodium chloride was dissolved in 1000 parts by mass of ion-exchange water was added to the reaction liquid to terminate the increase of the particle size. Core particles were thus prepared.

(Formation of Shell (Production of Toner Base Particle 1))

The temperature of 550 parts by mass of a dispersion liquid of the above core particles (on a solid content basis) was controlled to 90° C., and 50 parts by mass of the shell-use resin fine particle [1] dispersion liquid was added thereto. Then, stirring of the resulting liquid was continued for an hour to fuse the shell-use resin fine particles on the core particles. Thereafter, an aqueous solution in which 40.2 parts by mass of sodium chloride was dissolved in 1000 parts by mass of ion-exchange water was added to the resulting liquid, followed by stirring with heat at 95° C. for 20 minutes to develop a shell. Then the resulting liquid was cooled to 30° C.

The obtained toner base particle dispersion liquid was filtrated, and the filtrate was washed with an ion-exchange water having a mass ten times that of the toner base particles and being at 35° C., three times, followed by drying with hot air at 40° C. Toner base particles 1 with a structure in which the core particles were covered with a shell (shell coating) were thus prepared.

(Addition of Exterior Additive to Toner Base Particle 1)

On the toner base particles 1, 1.0 part by mass of hydrophobic silica (with a number average primary particle diameter of 12 nm and a hydrophobization degree of 68) and 1.5 parts by mass of hydrophobic titanium oxide (with a number average primary particle diameter of 20 nm and a hydrophobization degree of 64) were added. Then, they were mixed with each other using a HENSCHEL mixer (manufactured by NIPPON COKE & ENGINEERING. CO., LTD.), and large crude particles were removed using a sieve with a mesh size of 45 μm. Toner particles 1 were thus produced.

<Production of Toner Particle 2>

Toner particles 2 were produced by the same way as the toner particles 1 were prepared except that the filtrate was further washed with a 10-fold amount of 0.5 mass % aqueous solution of sodium dodecyl sulfate after the three washings with an ion-exchange water having a mass ten times that of the toner base particles.

<Production of Toner Particle 3>

Toner particles 3 were produced by the same way as the toner particles 1 were prepared except that the filtrate was washed with an ion-exchange water having a mass ten times that of the toner base particles, ten times.

<Production of Toner Particle 4>

Toner particles 4 were produced by the same way as the toner particles 1 were prepared except that the filtrate was further washed with a 10-fold amount of 1 mass % aqueous solution of sodium dodecyl sulfate after the three washings with an ion-exchange water having a mass ten times that of the toner base particles.

<Production of Toner Particle 5>

Toner particles 5 were produced by the same way as the toner particles 1 were prepared except that t-butyl hydroperoxide was used as the polymerization initiator and alkylaryl polyethylene glycol ether was used as the surfactant.

TABLE 2

| | Polymerization ihitiator | Surfactant | S/C |
|---|---|---|---|
| Toner Particle 1 | Potassium persulfate | Sodium dodecyl sulfate | 0.0031 |
| Toner Particle 2 | Potassium persulfate | Sodium dodecyl sulfate | 0.006 |
| Toner Particle 3 | Potassium persulfate | Sodium dodecyl sulfate | 0.0010 |
| Toner Particle 4 | Potassium persulfate | Sodium dodecyl sulfate | 0.0080 |
| Toner Particle 5 | t-butyl hydroperoxide | Alkylaryl polyethylene glycol ether | 0 |

<Production of Developing Agent>

(Production of Two-Component Developing Agent 1)

A two-component developing agent 1 was produced by blending 95 parts by mass of the carrier particles 1 and 5 parts by mass of the toner particles 1 under normal temperature and humidity (at 20° C. and 50% RH) using a V blender to mix the carrier particles and the toner particles at a rotation speed of 20 rpm for 20 minutes. The obtained mixture was sieved with a sieve with a mesh size of 125 μm.

(Production of Two-Component Developing Agents 2 to 23)

Two-component developing agents 2 to 23 were prepared by the same way as the two-component developing agent 1 was prepared except that one of the carrier particle 2 to 19 and one of the toner particles 1 to 5 were mixed as shown in Table 3. The two-component developing agents 16 to 19 and 23 were used for comparison.

TABLE 3

| | Carrier Particle | | | |
|---|---|---|---|---|
| | No. | Coating resin | Toner No. | Note |
| Two-component developing agent 1 | Carrier Particle 1 | Coating resin 1 | Toner patricle 1 | Present invention |
| Two-component developing agent 2 | Carrier Particle 2 | Coating resin 2 | Toner patricle 1 | Present invention |
| Two-component developing agent 3 | Carrier Particle 3 | Coating resin 3 | Toner patricle 1 | Present invention |
| Two-component developing agent 4 | Carrier Particle 4 | Coating resin 4 | Toner patricle 1 | Present invention |
| Two-component developing agent 5 | Carrier Particle 5 | Coating resin 5 | Toner patricle 1 | Present invention |
| Two-component developing agent 6 | Carrier Particle 6 | Coating resin 6 | Toner patricle 1 | Present invention |
| Two-component developing agent 7 | Carrier Particle 7 | Coating resin 7 | Toner patricle 1 | Present invention |
| Two-component developing agent 8 | Carrier Particle 8 | Coating resin 8 | Toner patricle 1 | Present invention |
| Two-component developing agent 9 | Carrier Particle 9 | Coating resin 9 | Toner patricle 1 | Present invention |
| Two-component developing agent 10 | Carrier Particle 10 | Coating resin 10 | Toner patricle 1 | Present invention |
| Two-component developing agent 11 | Carrier Particle 11 | Coating resin 11 | Toner patricle 1 | Present invention |
| Two-component developing agent 12 | Carrier Particle 12 | Coating resin 12 | Toner patricle 1 | Present invention |
| Two-component developing agent 13 | Carrier Particle 13 | Coating resin 13 | Toner patricle 1 | Present invention |
| Two-component developing agent 14 | Carrier Particle 14 | Coating resin 14 | Toner patricle 1 | Present invention |
| Two-component developing agent 15 | Carrier Particle 15 | Coating resin 15 | Toner patricle 1 | Present invention |
| Two-component developing agent 16 | Carrier Particle 16 | Coating resin 16 | Toner patricle 1 | Comparative example |
| Two-component developing agent 17 | Carrier Particle 17 | Coating resin 17 | Toner patricle 1 | Comparative example |
| Two-component developing agent 18 | Carrier Particle 18 | Coating resin 18 | Toner patricle 1 | Comparative example |
| Two-component developing agent 19 | Carrier Particle 19 | Coating resin 19 | Toner patricle 1 | Comparative example |
| Two-component developing agent 20 | Carrier Particle 1 | Coating resin 1 | Toner patricle 2 | Present invention |
| Two-component developing agent 21 | Carrier Particle 1 | Coating resin 1 | Toner patricle 3 | Present invention |
| Two-component developing agent 22 | Carrier Particle 1 | Coating resin 1 | Toner patricle 4 | Present invention |
| Two-component developing agent 23 | Carrier Particle 1 | Coating resin 1 | Toner patricle 5 | Comparative example |

<<Evaluation>>

For evaluating the two-component developing agents, a commercially available high-speed monochrome on-demand printer "BIZ-HUB PBS 1050" (manufactured by Konica Minolta Business Solutions Japan Co., Ltd.) was used. The two-component developing agents were put in this printer one by one, and printing of 500,000 sheets was conducted.

In the printing, a character image with a coverage rate of 5% was printed on 50,000 sheets of A4 under normal temperature and humidity (at 20° C. and 50% RH) and high temperature and humidity (at 30° C. and 80% RH).

(Evaluation for Fogging)

The density of blank transfer sheets subjected to printing before and after the printing of the character image with a coverage rate of 5% on 500,000 sheets of A4 under normal temperature and humidity (20° C. and 50% RH) and high temperature and humidity (at 30° C. and 80% RH) was evaluated. Fogging was evaluated on the basis of the density of a blank transfer sheet conveyed through the printer without printing thereon. The density of the blank transfer sheet was an average of the densities of 20 points on the blank transfer sheet. The densities were measured with a reflection densitometer RD-918 (manufactured by Macbeth Corp.). A fogging of 0.01 or less was acceptable.

(Evaluation for Toner Scattering in Printer)

The level of toner scattering in the printer is visually evaluated after 10,000 blank transfer sheets were conveyed and after 500,000 blank transfer sheets were conveyed through the printer without printing thereon under high temperature and humidity (at 30° C. and 80% RH). In Table 4, ◎ and ○ indicate that the level of toner scattering in the printer was acceptable.

(Evaluation Criteria)

◎: no staining of toner particles was found

○: toner scattering was slightly observed in the printer

X: many toner particles were scattered and the inside of the printer needed to be cleaned

TABLE 4

| | Before printing | | | After printing | | | |
|---|---|---|---|---|---|---|---|
| | Fogging | | Toner scattering | Fogging | | Toner scattering | |
| | NH | HH | HH | NH | HH | HH | Note |
| Two-component developing agent 1 | 0.001 | 0.002 | ◎ | 0.001 | 0.002 | ◎ | Present invention |
| Two-component developing agent 2 | 0.001 | 0.002 | ◎ | 0.001 | 0.002 | ◎ | Present invention |
| Two-component developing agent 3 | 0.001 | 0.002 | ◎ | 0.001 | 0.002 | ◎ | Present invention |
| Two-component developing agent 4 | 0.001 | 0.002 | ◎ | 0.001 | 0.002 | ○ | Present invention |
| Two-component developing agent 5 | 0.002 | 0.003 | ◎ | 0.002 | 0.004 | ◎ | Present invention |
| Two-component developing agent 6 | 0.002 | 0.003 | ◎ | 0.002 | 0.004 | ◎ | Present invention |
| Two-component developing agent 7 | 0.003 | 0.003 | ◎ | 0.004 | 0.006 | ◎ | Present invention |
| Two-component developing agent 8 | 0.004 | 0.006 | ○ | 0.005 | 0.008 | ○ | Present invention |
| Two-component developing agent 9 | 0.002 | 0.003 | ◎ | 0.003 | 0.005 | ◎ | Present invention |
| Two-component developing agent 10 | 0.003 | 0.004 | ○ | 0.004 | 0.007 | ○ | Present invention |
| Two-component developing agent 11 | 0.001 | 0.002 | ◎ | 0.001 | 0.002 | ◎ | Present invention |
| Two-component developing agent 12 | 0.001 | 0.002 | ◎ | 0.001 | 0.002 | ◎ | Present invention |
| Two-component developing agent 13 | 0.001 | 0.002 | ◎ | 0.002 | 0.004 | ◎ | Present invention |
| Two-component developing agent 14 | 0.001 | 0.003 | ◎ | 0.002 | 0.005 | ◎ | Present invention |
| Two-component developing agent 15 | 0.002 | 0.003 | ◎ | 0.002 | 0.006 | ◎ | Present invention |
| Two-component developing agent 16 | 0.013 | 0.0018 | X | 0.020 | 0.025 | X | Comparative example |
| Two-component developing agent 17 | 0.005 | 0.007 | ◎ | 0.007 | 0.011 | ○ | Comparative example |
| Two-component developing agent 18 | 0.007 | 0.009 | ○ | 0.008 | 0.013 | X | Comparative example |
| Two-component developing agent 19 | 0.008 | 0.011 | ○ | 0.009 | 0.016 | X | Comparative example |
| Two-component developing agent 20 | 0.001 | 0.003 | ◎ | 0.002 | 0.005 | ◎ | Present invention |
| Two-component developing agent 21 | 0.001 | 0.003 | ◎ | 0.002 | 0.004 | ◎ | Present invention |
| Two-component developing agent 22 | 0.002 | 0.004 | ◎ | 0.003 | 0.007 | ○ | Present invention |
| Two-component developing agent 23 | 0.002 | 0.007 | X | 0.002 | 0.014 | X | Comparative example |

NH: normal temperature and humidity
HH: high temperature and humidity

As evident from the results shown above, the two-component developing agents 1 to 15 and 20 to 22 of the present invention are excellent because no fogging and toner scattering are caused after the printing of 500,000 transfer sheets. In contrast, the comparative two-component developing agents 16 to 19 and 23 are problematic at least one of the above evaluation points.

The present invention can provide a two-component developing agent that has high durability and avoids fogging and toner scattering caused by a change in the amount of charge of toner particles based on changes in environmental temperature and humidity, especially by a decrease in the amount of charge of toner particles due to hot and humid conditions, and can provide high-quality images, and provide a method for forming an electrophotographic image using the two-component developing agent for developing an electrostatic latent image.

Mechanisms that provide such advantages are not definitely revealed, but the following reasoning can be made.

In the present invention, a resin obtained by polymerizing an isobutyl methacrylate monomer which has high hydrophobicity is used as a coating resin in the carrier particles. By this configuration, water absorption of the carrier particles may be reduced, and thus environmental dependency of the amount of charge may be decreased.

It is generally understood that a minor element(s) in a coating resin and a toner base particle have a great effect on chargeability. In the present invention, sulfur atoms are included in a coating resin and a toner base particle, and when friction between the coating resin and the toner base particle occurs, the sulfur atom functions as an origin of charge. By using the same element that has a large effect on chargeability, i.e., a sulfur atom, in both of the coating resin and the toner base particle, changes in chargeability of the coating resin and the toner base particle based on moisture can be same. Thus, when they are mixed and used in a two-component developing agent for developing an electrostatic latent image, a change of the two-component developing agent in chargeability based on changes in environmental temperature and humidity can be much more reduced compared to any conventional developing agents.

The entire disclosure of Japanese Patent Application No. 2013-120318 filed on Jun. 7, 2013 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A two-component developing agent for developing an electrostatic latent image, comprising:

toner particles composed of toner base particles and an exterior additive attached on the toner base particles; and carrier particles composed of carrier core particles and a coating resin provided on the carrier core particles, wherein the coating resin comprises a sulfur atom and a resin obtained by polymerizing an isobutyl methacrylate monomer, the toner base particles comprise a sulfur atom, and a weight average molecular weight of the coating resin ranges from 300,000 to 1,000,000.

2. The two-component developing agent of claim 1, wherein the sulfur atom is included in the carrier coating resin as a member of a sulfo group or a sulfonate group in the coating resin.

3. The two-component developing agent of claim 1, wherein the sulfur atom is included in the toner base particles as a member of a sulfo group or a sulfonate group in the toner base particles.

4. The two-component developing agent of claim 1, wherein the sulfur atom is included in the carrier coating resin as a member of a sulfo group or a sulfonate group present at an end of a molecular chain of the coating resin.

5. The two-component developing agent of claim 1, wherein the toner base particle is formed with a resin, and the sulfur atom is included in the toner base particles as a member of a sulfo group or a sulfonate group positioned at an end of a molecular chain of the resin forming the toner base particles.

6. The two-component developing agent of claim 1, wherein the isobutyl methacrylate monomer is included as a copolymer component in the coating resin in a content of 20% by mass or more.

7. The two-component developing agent of claim 1, wherein the resin obtained by polymerizing the isobutyl methacrylate monomer is obtained by suspension polymerization or emulsion polymerization.

8. The two-component developing agent of claim 1, wherein the sulfur atom included in the coating resin satisfies a ratio (S/C) of a content of the sulfur atom in the coating resin (S) to a content of a carbon atom in the coating resin (C) of from 0.002 to 0.01, which contents are obtained using an X-ray photoelectron spectrometer.

9. The two-component developing agent of claim 1, wherein the sulfur atom included in the toner base particles satisfies a ratio (S/C) of a content of the sulfur atom in the toner base particles (S) to a content of a carbon atom in the toner base particles (C) ranges from 0.001 to 0.006, which contents are obtained using an X-ray photoelectron spectrometer.

10. A two-component developing agent for developing an electrostatic latent image, comprising:

toner particles composed of toner base particles and an exterior additive attached on the toner base particles; and carrier particles composed of carrier core particles and a coating resin provided on the carrier core particles, wherein the coating resin comprises a sulfur atom and a resin obtained by polymerizing an isobutyl methacrylate monomer, the toner base particles comprise a sulfur atom, and the sulfur atom included in the coating resin satisfies a ratio (S/C) of a content of the sulfur atom in the coating resin (S) to a content of a carbon atom in the coating resin (C) of from 0.002 to 0.01, which contents are obtained using an X-ray photoelectron spectrometer.

11. The two-component developing agent of claim 10, wherein the sulfur atom is included in the carrier coating resin as a member of a sulfo group or a sulfonate group in the coating resin.

12. The two-component developing agent of claim 10, wherein the sulfur atom is included in the toner base particles as a member of a sulfo group or a sulfonate group in the toner base particles.

13. The two-component developing agent of claim 10, wherein the sulfur atom is included in the carrier coating resin as a member of a sulfo group or a sulfonate group present at an end of a molecular chain of the coating resin.

14. The two-component developing agent of claim 10, wherein the toner base particle is formed with a resin, and the sulfur atom is included in the toner base particles as a member of a sulfo group or a sulfonate group positioned at an end of a molecular chain of the resin forming the toner base particles.

15. The two-component developing agent of claim 10, wherein the isobutyl methacrylate monomer is included as a copolymer component in the coating resin in a content of 20% by mass or more.

16. The two-component developing agent of claim 10, wherein the resin obtained by polymerizing the isobutyl methacrylate monomer is obtained by suspension polymerization or emulsion polymerization.

17. The two-component developing agent of claim 10, wherein the sulfur atom included in the toner base particles satisfies a ratio (S/C) of a content of the sulfur atom in the toner base particles (S) to a content of a carbon atom in the toner base particles (C) ranges from 0.001 to 0.006, which contents are obtained using an X-ray photoelectron spectrometer.

* * * * *